United States Patent [19]

Darooka

[11] Patent Number: 4,768,342

[45] Date of Patent: Sep. 6, 1988

[54] HEATER HEAD FOR A STIRLING ENGINE

[75] Inventor: Dilip K. Darooka, King of Prussia, Pa.

[73] Assignee: General Electric Company, King of Prussia, Pa.

[21] Appl. No.: 854,360

[22] Filed: Apr. 21, 1986

[51] Int. Cl.[4] ..... F02G 1/04

[52] U.S. Cl. ..... 60/525; 60/517

[58] Field of Search ..... 60/517, 520, 524, 525

[56] References Cited

U.S. PATENT DOCUMENTS 2,596,057 5/1952 Van Heeckeren ..... 60/524

FOREIGN PATENT DOCUMENTS 167376 6/1950 Austria ..... 60/517
523269 4/1954 Belgium ..... 60/525
2522711 12/1975 Fed. Rep. of Germany ..... 60/524
269898 9/1947 Switzerland ..... 60/517

*Primary Examiner*—Allen M. Ostrager
*Attorney, Agent, or Firm*—Clement A. Berard, Jr.; Raymone E. Smiley

[57] ABSTRACT

A Stirling engine heater head is constructed to provide an annular heat exchange region defined between a pressure vessel sidewall and the engine displacer cylinder. From an external manifold, through which a heated fluid flows, either heat pipes or heat exchange tubes are sealingly introduced into the heat exchange region. Thermal energy is thus transferred to the engine working fluid, while the heated fluid is maintained isolated from the vessel walls and the displacer cylinder. For a compound Stirling engine configuration, thermal energy is introduced from a common heated fluid manifold to the heat exchange regions of a pair of axially aligned Stirling engine modules via heat pipes or heat exchange tubes. This manifold may be sealingly joined with the pressure vessel to create a chamber which is pressurized to pressure balance the vessel walls.

5 Claims, 4 Drawing Sheets

HEATER HEAD FOR A STIRLING ENGINE

The present invention relates in general to heater heads for Stirling engines and more specifically to a novel Stirling engine heater head of improved construction, performance, and reliability.

BACKGROUND OF THE INVENTION

The Stirling thermodynamic cycle and heat engines employing same are well known in the art. Stirling engines typically utilize reciprocating pistons to convert heat energy introduced into the engine to mechanical or electrical energy. Stirling engines are basically of two types, the free piston type or the kinematic type. In a free piston Stirling engine, the engine housing or vessel is hermetically sealed to contain an engine working fluid and freely moving pistons which are not mechanically connected either to one another or to an external drive. A kinematic engine is one in which the engine housing is not hermetically sealed and in which there are mechanical connections both between engine pistons and to means external to the engine for extracting the engine's mechanical energy. Thus, a kinematic-type Stirling engine is best suited for automotive applications.

The first step of the Stirling thermodynamic cycle consists of an isothermal expansion of the working fluid contained in the engine's expansion space. In accordance with the ideal Stirling engine cycle, expansion of the working fluid should be effected isothermally. However, conventional Stirling engines, both of the free piston and kinematic type, are designed such that thermal energy is imparted to the working fluid before it enters the expansion space, and, largely as a consequence, idealized isothermic expansion of the working fluid is not realized.

For example, referring to FIG. 1, a free piston Stirling engine 20 typically comprises a displacer piston 22 and a compression piston 24 mounted on a common axis 26 within a hermetically sealed engine pressure vessel 28 for reciprocation in cylinders 30 and 32, respectively. A working fluid passes from a compression space 34, proximate one end of the compression piston, through a cooler 36, a regenerator 38 and a heater 40 into an expansion space 42 proximate one end of the displacer piston. A linear alternator 43 may be adapted to operate with compression piston 24 for extracting usable electrical energy. The heater, regenerator and cooler are each of a annular configuration disposed around the displacer cylinder. A typical prior art heater consists of a large number of small diameter tubes 44, arranged substantially parallel to axis 26 and through which the working fluid is conveyed between the compression and expansion spaces. For example, in a typical 25 KW Stirling engine as many as 1600 tubes, each of 1/16 inch inside diameter, are used. A heated liquid is pumped through the heater via inlet 40*a* and outlet 40*b* to contact the external tube surfaces in order to heat the working fluid flowing within the tubes. Thus, as can be seen in FIG. 1, thermal energy is introduced into the working fluid before it enters the expansion space where it undergoes the expansion step of the Stirling thermodynamic cycle. The engine working fluid is typically a gas such as hydrogen or helium. Thus, during the expansion of the gas, the gas temperature drops in accordance with the indirect relationship between gas temperature and volume. As a result, the expansion step is not as isothermal as called for in an ideal Stirling cycle, and engine operating efficiency suffers. It is thus desirable to isothermalize as much as possible the expansion step of the Stirling engine cycle.

The large number of tubes used in prior art heater heads also necessitates a net increase in the total volume of working fluid required in a Stirling engine. As is well understood in the art, that portion of the working fluid volume which is not swept by the pistons constitutes void volume and does not contribute to useful work. As void volume increases, the specific power output of a Sterling engine decreases. It is therefore desirable to minimize the working fluid void volume.

In the typical Stirling engine heater, such as diagrammatically illustrated in FIG. 1, a heated fluid is pumped through the void space between and about these tubes in order to introduce heat energy into the working fluid. Thus, the heated fluid, typically a molten metal such as lithium, normally contacts the wall of housing 28, as well as piston cylinder 30. Materials used in the constructions of housing 28 and cylinder 30 therefore must be of a character capable of withstanding the molten metal. Refractory materials such as niobium-1-Zirc alloy are most compatible with molten lithium. However, housing 28 and cylinder 30 may be required to withstand substantial pressures during engine operation, and refractory materials typically tend to be brittle and can lose their strength in contact with trace impurities typically present in the working fluid. Further, refractory materials are not castable and must therefore be machined to the desired shape and dimensions. It would be preferable to cast the housing and cylinder in order to simplify and cost-improve the manufacturing operation. Additionally, refractory materials are difficult to joint together.

The class of materials referred to as superalloys, e.g. MAR-M247, are castable and posses sufficient mechanical strength to withstand engine operating pressures and temperatures. Further, superalloys are compatible with the typical engine working fluids. However, superalloys are not compatible with molten metals such as molten lithium and for this reason are not appropriate as an engine housing material. Thus, prior art heater designs present engine material and fabrication shortcomings.

OBJECTS OF THE INVENTION

It is an object of the present invention to provide an improved heater head for a Stirling engine which is constructed to reduce the engine working fluid void volume;

It is another object of the present invention to provide a Stirling engine heater head of the above-character, wherein the expansion step of the Stirling engine cycle is more nearly isothermal;

It is a further object of the present invention to provide a Stirling engine heater head of the above-noted character which is constructed such as to optimize the materials selection in terms of mechanical strength and fluid compatibility; and It is an additional object of the present invention to provide a Stirling engine heater head of the above-character which is of a cost-improved construction and is reliable over a long operating life.

Other objects of the invention will in part be obvious and in part appear hereinafter.

SUMMARY OF THE INVENTION

These and other objects are accomplished by the present invention which is directed to a Stirling engine heater head of improved construction. The heater head comprises a pressure vessel having a headwall and a conjoined sidewall; the former cooperating with one end of a displacer piston to define an expansion space, and the latter cooperating with a displacer cylinder to define an annular heat exchange region in immediate proximity to and in open communication with the expansion space. The displacer piston is mounted for reciprocation in the displacer cylinder. In one embodiment, an engine working fluid occupying the expansion space and the heat exchange region is heated by a plurality of heat pipes sealingly introduced through a pressure vessel wall into the heat exchange region from an external manifold through which a heated fluid is pumped. In another embodiment, a plurality of heat exchange tubes, extending through the heat exchange region, are connected between external inlet and outle manifolds for conveying the heated fluid through the heat exchange region. Thermal energy is thus introduced into the working fluid flowing through the heat exchange region while maintaining the heated fluid isolated from the pressure vessel walls, the displacer cylinder, and the working fluid. Both the heat pipes and heat exchange tubes are sized and distributed throughout the heat exchange region so that the engine expansion space effectively extends into at least a portion of the heat exchange region. To enhance heat transfer efficiency, the flow of working fluid through the heat exchange region is confined to annular passages surrounding the heat pipes or heat exchange tubes. The term "tubular heat transfer elements", as used herein, includes heat pipes, heat exchange tubes or both.

In a further embodiment of the present invention, a pair of Stirling engine modules are positioned in axially aligned, compound fashion with their respective heater heads, constructed as generally described above, disposed in contiguous relation. The heat pipes or heat exchange tubes positioned in the respective heat exchange regions of the engine pair are coupled to a common source of heated fluid.

The invention accordingly comprises the features of construction, combinations of elements, and arrangements of parts which will be exemplified in the constructions hereinafter set forth, and the scope of the invention will be indicated in the claims.

BRIEF DESCRIPTION OF THE DRAWINGS

For a better understanding of the nature and objects of the invention, reference should be made to the following detailed description taken in conjunction with the accompanying drawings, in which.

Like reference numerals refer to corresponding parts throughout the several views of the drawings.

DETAILED DESCRIPTION

Figure 1:
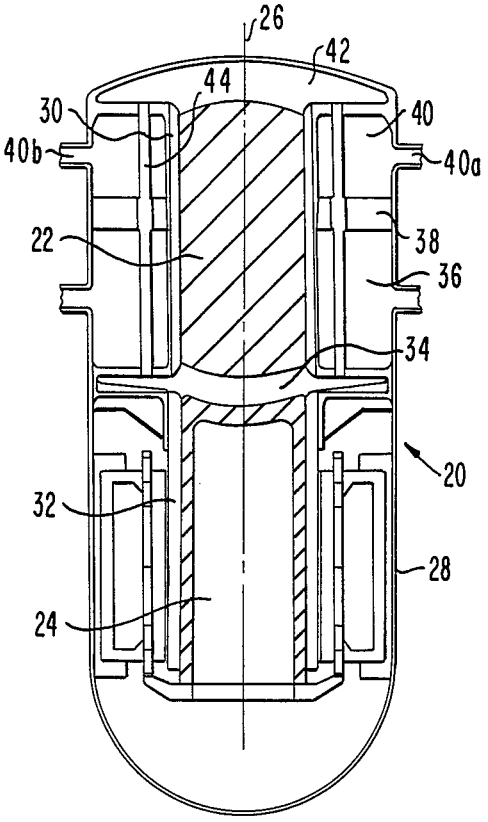
FIG. 1 PRIOR ART
FIG. 1 is a simplified axial sectional view of a prior art Stirling engine.
Figure 2:
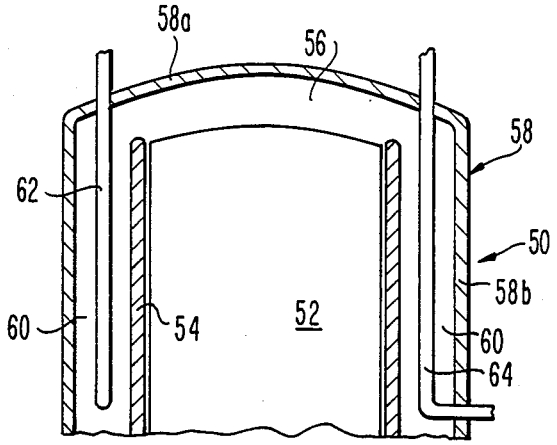
FIG. 2 is an axial sectional view of the heater head portion of a Stirling engine constructed in accordance with the present invention to utilize either heat pipes or heat exchange tubes.

In accordance with the embodiment of the present invention seen in FIG. 2, a Stirling engine heater head, generally indicated at 50, includes a displacer piston 52 mounted for reciprocation in a displacer cylinder 54 to act on a working fluid, such as hydrogen or helium, occupying an expansion space 56 defined between the upper end of the displacer piston and the headwall portion 58*a* of a hermetic pressure vessel enclosing the various Stirling engine components in the manner illustrated in FIG. 1. Defined between displacer cylinder 54 and a generally cylindrical sidewall 58*b* of vessel 58 is an annular heat exchange region 60 which is seen to be in open communication with expansion space 56.

In accordance with one embodiment of the invention, a multiplicity of heat pipes 62 are sealingly introduced through openings in headwall 58*a* for downward projection into annular heat exchange region 60. The upper ends of these heat pipes are disposed in a suitable manifold, such as disclosed in FIG. 5, in heat exchange relation with a heated fluid, e.g., molten lithium. Alternatively and as also seen in FIG. 2, the heated fluid may be pumped through a multiplicity of heat exchange tubes 64 sealingly introduced through openings in headwall 58*a* for extension axially downward through heat exchange region 60 and radially out through sealed openings in sidewall 58*b*. The open ends of these heat exchange tubes communicate with suitable inlet and outlet manifolds such as illustrated in FIG. 6.

As is readily seen in FIG. 2, heat pipes 62 or alternatively heat exchange tubes 64 are disposed in excellent heat exchange relation with the engine working fluid flowing through heat exchange region 60 between expansion space 56 and the engine compression space. It will be appreciated that the lower end of the heat exchange region seen in FIG. 2 communicates with a suitable regenerator which in turn communicates with an appropriate cooler in completing the working fluid flow path between the expansion and compression spaces, as illustrated in FIG. 1. By virtue of the relatively open communication between expansion space 56 and heat exchange region 60, the expansion space effectively assumes a significant volumetric portion of the exchange region. Thus, transfer of thermal energy to the working fluid as it undergoes expansion is more directly achieved, and therefore the expansion step of the Stirling thermodynamic cycle is isothermalized to a greater extent than has been achieved utilizing prior art heater head constructions. Moreover, greater temperature uniformity in the heat exchange region is achieved by use of heat pipes or heat exchange tubes that extend parallel to the axis of the displacer cylinder. Also, the improved efficiency of the heat transfer taking place in the heat exchange region 60 permits a reduction of the working fluid volume required therein. These two factors make possible a significant reduction in the working fluid void volume and a corresponding increase in Stirling engine specific output power.

Yet another advantage afforded by the present invention as seen from the embodiment illustrated in FIG. 2 is the fact that the heated fluid is isolated from the pressure withstanding members of the Stirling engine heater head 50, most significantly the headwall and sidewall of pressure vessel 58 and to a lesser extend displacer cylinder 54. Thus, materials for these pressure sustaining members may be selected on the basis of their compatibility with the working fluid, requisite mechanical strength to withstand elevated working fluid pressures and temperatures, and ease of manufacture, but, most importantly, without regard for their compatibility with the heated fluid utilized, e.g., molten lithium. Thus, materials of the class known as superalloys, e.g. MARM247, which are castable, of high mechanical strength, and compatible with typical engine working fluids, become highly suitable materials for at least the heater head portion of the engine pressure vessel, as well as the displacer cylinder. Heretofore, refractory materials, such as niobium-1-zirconium, were typically utilized for these pressure sustaining members to achieve the requisite compatibility with molten metals or salts. However, such refractory materials tend to be brittle and can lose their strength when subjected to trace impurities often present in typical engine working fluids. Consequently, engine life is severely limited. Moreover, refractory materials are not castable, and manufacturing pressure sustaining Stirling engine parts therefrom becomes an expensive proposition. Such refractory materials are, however, suitable for the heat exchange tubes. An appropriate material for the heat pipes is a molybdenum rhenium alloy. Their tubular configuration, plus the partial pressure balancing afforded by the fluids confined therein, renders them capable of withstanding the high working fluid pressures.

Figure 3:
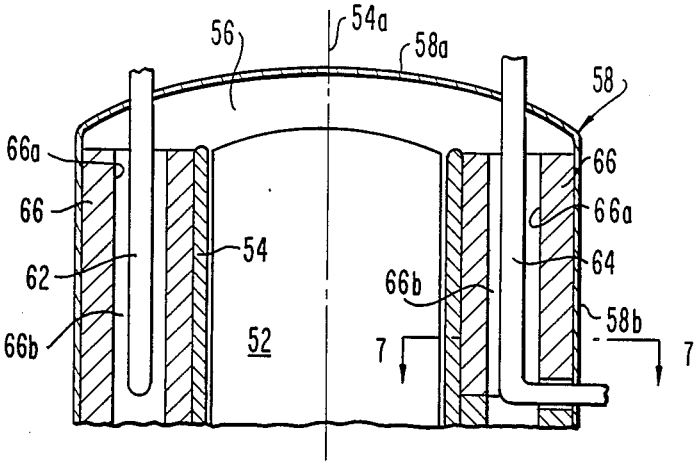
FIG. 3 is an axial sectional view of a Stirling engine heater head constructed in accordance with alternative embodiments of the present invention.

Turning to FIG. 3, to further enhance heat transfer efficiency and to further reduce working fluid void volume, an annular spacer 66 is situated in the heat exchange region defined between displacer cylinder 54 and pressure vessel sidewall **58*b*. A plurality of bores 66*a*, parallel to the displacer cylinder axis 54*a*, are drilled or otherwise suitably formed through the axial length of this spacer. This spacer may be formed of a superalloy. In one embodiment illustrated in FIG. 3, a heat pipe 62 is generally coaxially situated within each of these bores 66*a* in ample clearance with the bore sidewall. There is thus provided annular passages 66*b*** through which the engine working fluid flows in heat transfer relation with the heat pipes. It has been found that by confining working fluid flow to these annular passages in intimately surrounding relation with the heat pipes, the heat transfer coefficient is significantly improved. By injecting more thermal energy into the working fluid, engine power output is increased. It has been determined that operating temperatures of 1300° K. and above are achievable utilizing the teachings of the present invention.

As also seen in FIG. 3, rather than heat pipes, heat exchange tubes 64 may be coaxially disposed in the bores **66*a* to convey the molten lithium into heat transfer relation with the engine working fluid flowing through annular passages 66*b*. By way of example, the diameter of bores 66 may be 0.375 inches and the outer diameter of the heat pipes or heat exchange tubes 0.28 inches. In the case of heat exchange tubes, the inner diameter may be 0.25 inches. Under these circumstances, the cross sectional areas of the tube interior and the annular passages 66*b* are equal, which has been determined to be preferable in terms of balancing heat transfer efficiency and manufacturing economies. For a 25 KW Stirling engine, a heater head constructed in accordance with the present invention would require only as few as 32 to 48 heat exchange tubes or heat pipes. This constitutes a dramatic reduction from the 1600 heat exchange tubes required in prior art Stirling engine heater head designs. This constitutes significant manufacturing cost savings and improved operating reliability over a long service life. It will be appreciated that either the heat pipes or heat exchange tubes are uniformly distributed in spacer 66 about the displacer cylinder 54** on a common radius or on multiple radii, depending on the engine specifications.

Figure 4:
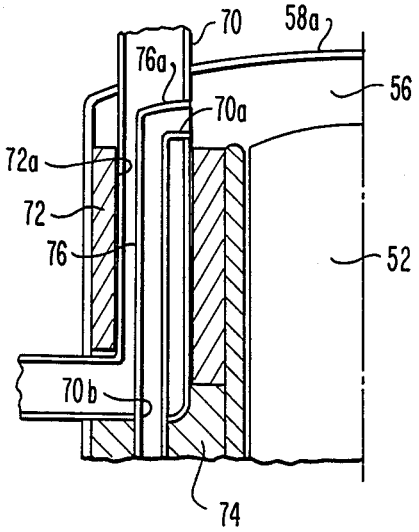
FIG. 4 is a fragmentary, axial section view of a Stirling engine heater head constructed in accordance with still another embodiment of the invention.

While the alternative constructions shown in FIG. 3 provide for the working fluid to flow in annular passages surround the thermal energy source, this relationship may be reversed. Thus, as seen in FIG. 4, a plurality of tubes 70 are sealingly introduced through openings in the pressure vessel headwall **58*a*. These tubes extend axially downwardly through the heat exchange region and radially outward through sealed openings in the pressure vessel sidewall 58*b* in the manner of exchange tubes 64 in FIGS. 2 and 3. These tubes may be relatively positioned and supported by an annular upper spacer 72 formed with bores 72*a* receiving the vertical sections of the tubes. A lower annular spacer 74 supports the elbows and radial sections of tubes 70. Each tube 70 is fitted with a coaxial inner tube 76 having a radially turned upper end section 76*a* whose termination is sealed in an opening 70*a* in tube 70. Thus, the upper end of the inner tube opens into expansion space 56. The vertical section of the inner tube passes sealingly through an opening 70*b* in the elbow section of outer tube 70 and beyond through a bore 74*a* in lower spacer 74 into the Stirling engine regenerator. It is thus seen from the construction illustrated in FIG. 4 that molten lithium is pumped through outer tube 70 to transfer thermal energy to engine working fluid flowing through coaxial inner tube 76**.

Figure 5:
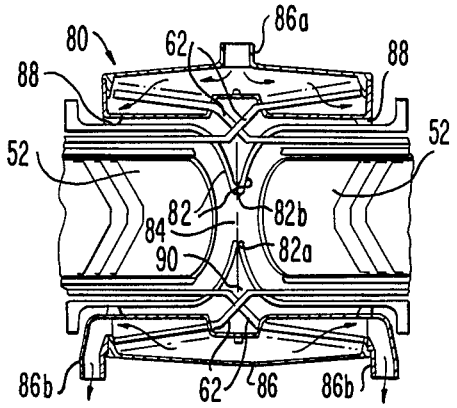
FIG. 5 is an axial sectional view of a heater head constructed in accordance with the present invention for application to a compound Stirling engine.
Figure 6:
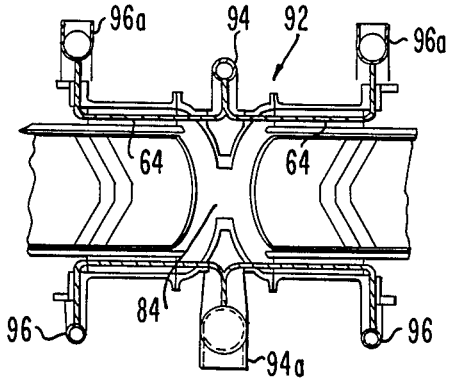
FIG. 6 is an axial sectional view of a modified heat head construction for application to a compound Stirling engine.

Turning to FIG. 5, the teachings of the present invention are applied to a heater head, generally indicated at 80, which is adapted to a compound Stirling engine configuration, wherein the displacer pistons 52 of a pair of Stirling engine modules are coaxially aligned in opposed, end-to-end relation. The engine modules may be constructed in accordance with the teachings of applicant's commonly assigned application entitled "Power Conversion System Utilizing Multiple Stirling Engine Modules" Ser. No. 854,362, filed concurrently herewith, now U.S. Pat. No. 4,723,411, issued Feb. 9, 1988. The disclosure of this copending application is specifically incorporated herein by reference. By virtue of this arrangement, the pressure vessel headwalls 82 of the two engine modules can be sealed together along a circumferential junction indicated at **82*a* to permit the creation of a headwall opening 82*b*, whereby the expansion spaces of the two engine modules are in open communication with each other. It is seen that the two engine modules thus conveniently share a common expansion space 84. Disposed about heater head 80 is an annular manifold 86, of a refractory material, into which a suitable molten metal or salt is introduced via inlet 86*a* and removed via outlets 86*b*. Heat pipes 62, seen to be of an S-shaped configuration, have their one end portions situated in heat transfer relation with the heated fluid pumped through manifold 86 and their other end portions disposed in heat transfer relation with the engine working fluid of one or the other of the two engine modules in the manner shown in either FIGS. 2 or 3**. By virtue of this arrangement, the heat pipes are heated from an essentially common source and equal quantities of thermal energy are imparted to the working fluid of the two engine modules. As described in detail in the above-noted copending application, self-balanced, essentially synchronized operation of the two engine modules is achieved with each developing virtually the same output power.

An additional feature of the invention illustrated in FIG. 5 is that manifold 80 may be sealingly joined to the pressure vessel sidewalls of the two engine modules along circumferential junctures indicated at 88. This serves to provide a hermetic annular chamber 90 which is pressurized with a suitable gas. By virtue of this arrangement, the walls of the pressure vessels can be to a substantial degree pressure balanced for at least the baseline pressure of the engine working fluid. Thus, wall thickness can be reduced for savings in material costs, weight and heat conduction losses.

FIG. 6 illustrates a heater head 92 for a compound Stirling engine which utilizes heat exchanges tubes 64, rather than heat pipes. As in the embodiment of FIG. 5, the two engine modules share a common expansion space 84. The inlet ends of the heat exchange tubes external to the pressure vessels of the two engine modules communicate with an annular inlet manifold 94 into which heated fluid is introduced via inlet pipe 94*a*. As in the embodiments of FIGS. 2 and 3, the heat exchange tubes 64 extend through the heat exchange region of each engine modules, with their outlet ends coupled into annular outlet manifolds 96. Thus, the heated fluid is pumped through the heat exchange tubes for both engine modules to uniformly heat the working fluids thereof. Outlet pipes 96*a* convey the molten metal away from the outlet manifolds for reheating and subsequent return to the inlet manifold in closed loop fashion.

Figure 7:
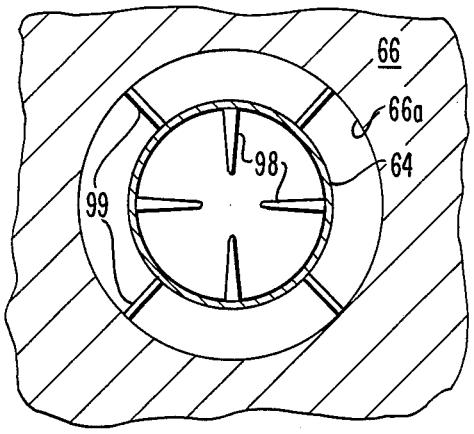
FIG. 7 is a sectional view taken along line 7—7 of FIG. 3 showing the adaptation of fins to the heat exchange tubes to enhance heat transfer to the engine working fluid.

FIG. 7 illustrates that the heat exchange tubes 64 may be provided with axially elongated, inwardly radiating fins 98 and/or outwardly radiating fins 99 to further improve heat transfer efficiency. It will be appreciated that heat pipes 62 may also be equipped with radiating fins for the same purpose. The fins 99 may emanate radially outward from the tubes or radially inward from the bore sidewalls 66*a*. Alternatively, these fins may be connected to both the tubes and the bore sidewalls to provide increased pressure withstand and to discourage tube rupture due to high temperature creepage.

It is thus seen that the objects of the present invention set forth above, including those made apparent from the preceding description, are efficiently attained, and, since certain changes may be made in the above constructions without departing from the scope of the invention, it is intended that all matter contained in the above description and shown in the accompanying drawings shall be interpreted as illustrative and not in a limiting sense.

Having described the invention, what is claimed as new and desired to secure by Letters Patent is:

1. A heater head for a compound Stirling engine modules, each including a displacer cylinder coaxially aligned with the displacer cylinder of the other of said engine modules, a displacer piston mounted for reciprocation in said displacer cylinder, said heater head comprising, in combination:

A. a pressure vessel including a pair of headwalls and a generally cylindrical sidewall joined with each said headwall, said headwalls being sealingly joined together about an opening to provide a common expansion space generally defined between said headwalls and opposed one ends of said displacer pistons of said engine modules, said common expansion space containing an engine working fluid;

B. an annular heat exchange region generally defined between each said sidewall and each said displacer cylinder, said heat exchange regions being in open communication with said common expansion space and accommodating the flow of said working fluid therethrough;

C. at least one annular manifold situated externally about said pressure vessel for accommodating the flow of a heated fluid therethrough; and D. a plurality of separate tubular heat transfer elements sealingly introduced from said manifold through said common expansion space into said heat exchange regions of both said engine modules with said plurality of separate tubular heat transfer elements being generally distributed about said annular heat exchange regions for transferring the thermal energy in said heated fluid to said working fluid in said heat exchange regions while maintaining said heated fluid in isolated relation to said pressure vessel walls, said displacer cylinders, and said working fluid.

2. The heater head defined in claim 1, wherein said plurality of tubular heat transfer elements comprises a plurality of heat pipes.

3. The heater head defined in claim 1, which includes an inlet manifold and at least one outlet manifold, said plurality of tubular heat transfer elements comprises a plurality of separate heat exchange tubes connected in parallel between said inlet and outlet manifolds for accommodating the flow of said heated fluid through said heat exchange regions for both said engine modules.

4. The heater head defined in claim 1, wherein said manifold is sealingly joined to said sidewalls to define with said sidewalls an annular chamber, said chamber being pressurized such as to at least partially counterbalance the internal pressure exerted on said pressure vessel walls by said working fluid.

5. The heater head defined in claim 1 wherein said headwalls are made of a superalloy material such as MAR-M247 which is castable.

* * * * *